US010487527B2

(12) United States Patent
Jenks

(10) Patent No.: US 10,487,527 B2
(45) Date of Patent: Nov. 26, 2019

(54) TORNADO PROOF HOUSING

(71) Applicant: Grizzly Homes, Inc., Azle, TX (US)

(72) Inventor: Joseph E. Jenks, Weatherford, TX (US)

(73) Assignee: Grizzly Homes, Inc., Azle, TX (US)

( * ) Notice: Subject to any disclaimer, the term of this patent is extended or adjusted under 35 U.S.C. 154(b) by 150 days.

(21) Appl. No.: 15/685,785

(22) Filed: Aug. 24, 2017

(65) Prior Publication Data

US 2019/0063099 A1 Feb. 28, 2019

(51) Int. Cl.

| | |
|---|---|
| ***E04B 1/00*** | (2006.01) |
| ***E04H 9/14*** | (2006.01) |
| ***E04B 1/348*** | (2006.01) |
| ***E04B 1/16*** | (2006.01) |
| ***E04B 1/20*** | (2006.01) |
| *E04B 2/86* | (2006.01) |

(52) U.S. Cl.

CPC ..... *E04H 9/14* (2013.01); *E04B 1/161* (2013.01); *E04B 1/165* (2013.01); *E04B 1/20* (2013.01); *E04B 1/34823* (2013.01); *E04B 2/8635* (2013.01); *E04B 2002/8682* (2013.01); *E04B 2103/02* (2013.01)

(58) Field of Classification Search

CPC ..... H04H 9/14; H04H 9/21; H04H 9/025; H04H 9/00; H04H 9/16; H04H 9/06; E04B 1/34823; E04B 1/165; E04B 1/20; E04B 1/161; E04B 2103/02; E04B 1/04; E04B 1/16

USPC ..... 52/251, 415, 169.6, 169.9, 741.12, 79.1, 52/79.11, 169.1, 169.8, 169.14, 741.1, 52/742.14

See application file for complete search history.

(56) References Cited

U.S. PATENT DOCUMENTS

| | | | | |
|---|---|---|---|---|
| 1,706,496 | A | 3/1929 | Pieri | |
| 3,315,424 | A * | 4/1967 | Smith | E04B 1/161 264/35 |
| 4,050,213 | A * | 9/1977 | Dillon | E04B 1/161 52/251 |
| 4,126,972 | A | 11/1978 | Silen | |
| 6,038,824 | A * | 3/2000 | Hamrick, Sr. | E04B 1/34336 52/125.2 |
| 6,256,960 | B1 * | 7/2001 | Babcock | E04B 1/14 52/281 |
| 6,393,776 | B1 | 5/2002 | Waller et al. | |
| 6,530,553 | B1 * | 3/2003 | Diorio | E04B 5/38 249/13 |

(Continued)

OTHER PUBLICATIONS

News Scope, Precast; "Mass-Produced, hurricane-resistant homes become reality";Concrete Products Magazine; Article; 3 pages; © Oct. 2011; www.concreteproducts.com.

*Primary Examiner* — Chi Q Nguyen

(74) *Attorney, Agent, or Firm* — Whitaker Chalk Swindle & Schwartz PLLC; Charles Gunter

(57) ABSTRACT

A tornado resistant/proof residential housing unit that is built to withstand natural disaster conditions resulting from tornadoes, violent storms, and fire. An internal concrete reinforced core layout gives the unit its structural strength, as well as the versatility needed to face natural disaster conditions while providing absolute resistance to heavy winds such as those caused by a tornado. The unit has an external facade which mimics the exterior appearance of a typical subdivision home.

5 Claims, 18 Drawing Sheets

(56) References Cited

U.S. PATENT DOCUMENTS

| | | | | |
|---|---|---|---|---|
| 7,784,223 | B1 * | 8/2010 | Ramey | E04B 1/04 52/79.1 |
| 7,921,604 | B2 | 4/2011 | Lino | |
| 8,800,227 | B2 * | 8/2014 | LeBlang | E04B 1/165 52/309.11 |
| 9,856,639 | B2 * | 1/2018 | Koszo | E04B 1/165 |
| 2001/0039770 | A1 * | 11/2001 | Arnold | E04H 9/06 52/169.6 |
| 2004/0159061 | A1 | 8/2004 | Schmidt | |
| 2009/0013621 | A1 | 1/2009 | Marroquin | |
| 2009/0107065 | A1 * | 4/2009 | LeBlang | E04B 1/165 52/252 |
| 2012/0047816 | A1 * | 3/2012 | Zhong | E04B 1/161 52/11 |
| 2014/0157704 | A1 * | 6/2014 | McDonagh | E04G 11/062 52/426 |
| 2015/0204085 | A1 * | 7/2015 | Koszo | E04B 1/165 52/742.14 |

* cited by examiner

TORNADO PROOF HOUSING

BACKGROUND OF THE INVENTION

1. Field of the Invention

The present invention relates to construction methods for constructing a building, such as a residential structure, which has storm protection features and, more specifically, to a tornado resistant/proof residential dwelling structure.

2. Description of the Prior Art

A variety of storm resistant building/shelter systems are known in the prior art. These systems are intended to protect against such catastrophic events as hurricanes and tornados where potentially deadly destructive forces such as high wind velocities and high pressure differentials (as associated with tornados) and high wind and rain (as associated with hurricanes) exist.

The present invention could be applied to storm resistant buildings of a variety of types. However, the invention has particular applicability to tornado resistant/proof residential structures. Certain geographical areas are known to suffer from a high incidence of tornados. Generally, tornado-prone areas occur at middle latitudes where cold, dry air at a high altitude in the atmosphere meets warm, moist tropical air closer to the surface of the earth. For example, the central United States is prone to tornadoes because cold, dry air from the Rocky Mountains often meets moist, warm air from the southeastern United States. The damage to buildings, including residential dwellings, is extremely costly and, even worse, often includes loss of life. People are often injured or killed from total or partial collapse of the structure they are in, or from flying debris if they are not able to find adequate shelter in time. Tornados are capable of producing deadly air funnels with winds moving at 100 to 250 miles per hour or more. Tornadoes travel forward at an average speed of 35 miles per hour and their paths often cover as much as hundreds of yards in width. Because of their awesome destructive power, it is critical that human beings be able to find a strong protective shelter fast.

To reduce tornado injuries, people often find shelter in the basement of their homes. However, many people live in structures which have no basement. For people who live in a structure without a basement, other types of tornado protection shelters exist, often separate from the dwelling. However, these forms of tornado protection are limited because they require time for people to obtain shelter within the structure after they realize a tornado is approaching. This is difficult because of the unpredictable nature of tornadoes and the speed with which they form and travel. Thus, there is a need for a tornado resistant building design that encompasses an entire building structure, while at the same time providing a comfortable residence.

A brief survey of tornado resistant/proof structures includes the following: U.S. Pat. No. 1,706,496, is a very early patent on an "earthquake and tornado proof building" which, while probably not practical today, shows the long standing need for a solution to the problem at hand.

U.S. Pat. No. 4,126,972, describes a "tornado protection building", one of the rooms of which has a tornado protection assembly extending across the top and sides of its interior, the building having a concrete slab under it, into which the protection assembly is anchored. The "storm proof room" is intended to resist forces in all directions exerted by a tornado, thereby protecting a first floor space which is part of a small, basement-less house.

U.S. Pat. No. 6,393,776, discloses a protective shelter for installation above and in the ground including a superstructure style frame, a composite wall structure for absorbing energy from forceful impacts, and a tub encased in a foundation. The tub provides a downward force such that the superstructure is not floated out of the excavation when the encasement is poured.

U.S. Pat. No. 7,921,604, describes an aluminum-foam structural housing unit that is stormproof, self-contained, and built to withstand natural disaster conditions resulting from hurricanes, tornadoes, earthquakes, and fire. The unit is buoyant during flooding conditions and lifts from the ground where it is guided by vertical poles to maintain a horizontal orientation. The unit also automatically disconnects from public utility systems as lifting occurs, and it then provides its inhabitants with self-contained sources of water, electrical energy, and sewage management.

U.S. Publication No. 2009/0013621, shows a tornado resistant structure which includes a base and a building structure positioned on the base. The building structure includes a plurality of deflection walls and reinforced corners and a plurality of skylights carried on a roof of the building structure.

The building structure includes an entrance and a drain positioned proximate to the entrance. The above discussion is not intended to be exhaustive, but merely illustrative of the types of structures and systems that have been envisioned in the prior art to address the problem of the tornado resistant/proof structure.

The more practical of the prior art structures are probably those which incorporate a "safe room" built within the traditional residential dwelling structure, as well as the known building systems where the entire external wall structure of a residential structure is built of reinforced concrete, or the like. A primary problem with the "safe room" approach is that everyone may not make it into the protective space in time. One disadvantage of the overall concrete "bunker" building approach is that such structures tend to be unattractive or down right unsightly and would not be allowed in many modern home subdivisions.

Thus, a need continues to exist for a tornado resistant/proof building, particularly a residential dwelling structure, which encompasses an entire building structure, not just the external sidewalls or an internal "safe room" and yet which has the appearance of a traditional, comfortable residence.

SUMMARY OF THE INVENTION

The present invention is directed toward materials and methods of constructing a tornado resistant/proof building structure and particularly toward a tornado proof residential dwelling structure. A main object of the invention is to provide such a structure which provides "whole house protection" for the occupants of the house from tornados or other dangerous weather events, while presenting an attractive external "facade" which looks the same for all practical purposes as any other typical house in a common housing subdivision.

The tornado resistant/proof residential housing unit of the invention is built to withstand natural disaster conditions resulting from such natural disasters as tornadoes, violent storms and fire. An internal concrete reinforced core layout gives the unit its great strength, as well as the versatility needed to face natural disaster conditions while providing absolute resistance to heavy winds such as those caused by a tornado. The unit has an attractive external facade which can assume virtually any appearance that the home buyer might desire, the internal reinforcing elements being entirely unobservable by the ordinary viewer.

In one preferred form, a tornado resistant/proof dwelling structure is provided which first includes a concrete slab upon which the remainder of the reinforced constituents of the structure will be erected. A series of interconnected reinforced concrete boxes are built upon the concrete slab, each having sidewalls, an initially open top, and a bottom which is enclosed by the concrete slab. A reinforced concrete ceiling is then erected which covers and encloses the top of the interconnected concrete boxes to form an internal reinforced concrete central core layout for the dwelling structure.

The internal reinforced concrete central core layout has internal walls and external walls which are all constructed from insulated concrete forms (ICF's) which have been filled with concrete and reinforcing rebar. The external walls of the internal reinforced concrete central core layout are provided with an external facade which mimics the exterior appearance of a typical subdivision home. The internal walls can also be finished out in conventional fashion. In the case of the dwelling structure of the invention, the internal reinforced concrete central core layout of the structure is capable of withstanding wind gusts on the order of 250 mph, or more, such as might be encountered in tornado conditions.

Additional objects, features and advantages will be apparent in the written description which follows.

DETAILED DESCRIPTION OF THE INVENTION

Figure 1:
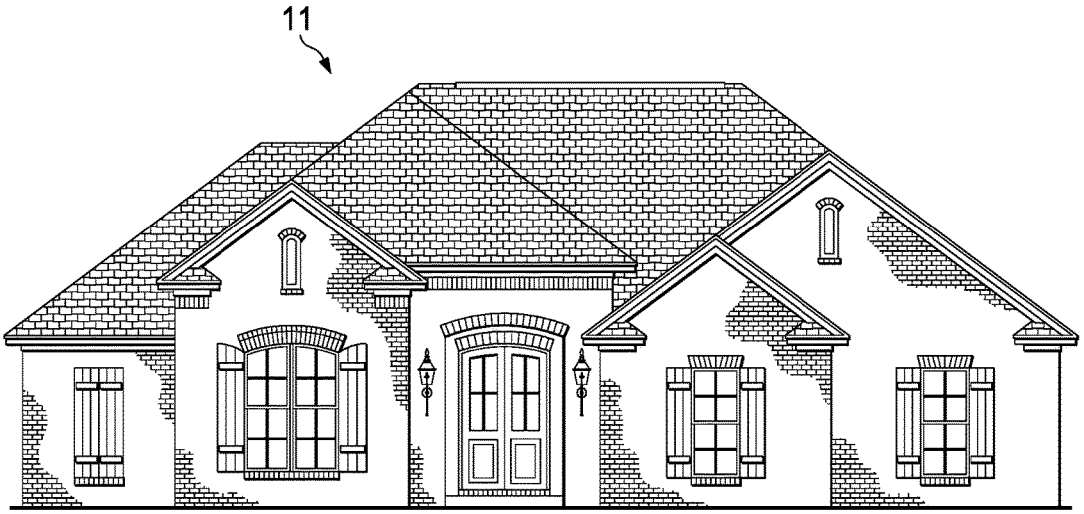
FIG. 1 is a front view of a residential dwelling structure built with the materials and according to the method of the present invention.

The preferred version of the invention presented in the following written description and the various features and advantageous details thereof are explained more fully with reference to the non-limiting examples included and as detailed in the description which follows. Descriptions of well-known components and processes and manufacturing techniques are omitted so as to not unnecessarily obscure the principal features of the invention as described herein. The examples used in the description which follows are intended merely to facilitate an understanding of ways in which the invention may be practiced and to further enable those skilled in the art to practice the invention. Accordingly, the examples should not be construed as limiting the scope of the claimed invention.

As briefly mentioned, the present invention is directed toward materials and methods of constructing a tornado resistant/proof building structure and particularly toward a tornado proof residential dwelling structure. A main object of the invention is to provide such a structure which provides "whole house protection" for the occupants of the house from tornados or other dangerous weather events, while presenting an attractive external "facade" which looks the same for all practical purposes as any other similar house plan in a common neighborhood or subdivision.

Tornados are among the most violent known meteorological events. Each year, more than 2,000 tornadoes occur worldwide, with the vast majority occurring in the United States and Europe. In order to assess the intensity of these events, meteorologist Ted Fujita devised a method to estimate maximum winds within the storm based on damage caused; this became known as the Fujita scale. At the top end of the scale, which ranks from 0 to 5, are F5 tornadoes. These storms were estimated to have had winds between 260 mph (420 km/h) and 320 mph (510 km/h). In more recent years, engineers have designed a more comprehensive scale that takes into account some 28 different damage indicators; this became known as the Enhanced Fujita scale. According to this scale, winds in an EF5 tornado are estimated to be in excess of 200 mph (320 km/h), perhaps as much as 250 mph, or more. Since building structures are typically completely destroyed in these situations, the identification and assignment of scale between an EF4 tornado and an EF5 is often very difficult. The present invention has as one object to provide "whole house" protection to the dwelling inhabitants, even during the disaster type situation accompanying an EF4 or EF5 tornado.

There are a number of reasons that the construction techniques of the present invention provide advantages over other "safe room" or "storm shelter" designs known in the marketplace. For example, underground tornado shelters typically offer maximum tornado safety. However, many areas are not conducive to building underground "storm shelters" and many dwelling structures do not have basements. Also, the water table in some areas may practically prohibit building underground storm shelters or basements. In addition, underground construction costs are often greater than above-ground construction costs.

The only alternative to underground shelters is above-ground shelters or structures. While certain of the prior art building techniques have involved solid concrete external walls, these structures tended to be unattractive and would not be allowed in many modern subdivisions due to building code issues, homeowner covenants, and the like. Typical above-ground dwelling structures constructed of traditional wood, brick and mortar are vulnerable to tornadoes due to their high wind resistance and low structural strength. None of these traditionally constructed dwelling structures would withstand the wind force present in an EF4 or EF5 tornado.

Other attempts to address this problem have included solutions which involved building designs or unique or unusual appearance. For example, with regard to wind resistance in above-ground structures, a spherical dome would be expected to have the lowest all-around wind resistance. However, curved surfaces are not as easy to work with or manufacture as are planar surfaces. The appearance of these structures, like solid concrete buildings, would not lend their designs to being incorporated in the typical homeowner subdivision.

Figure 2:
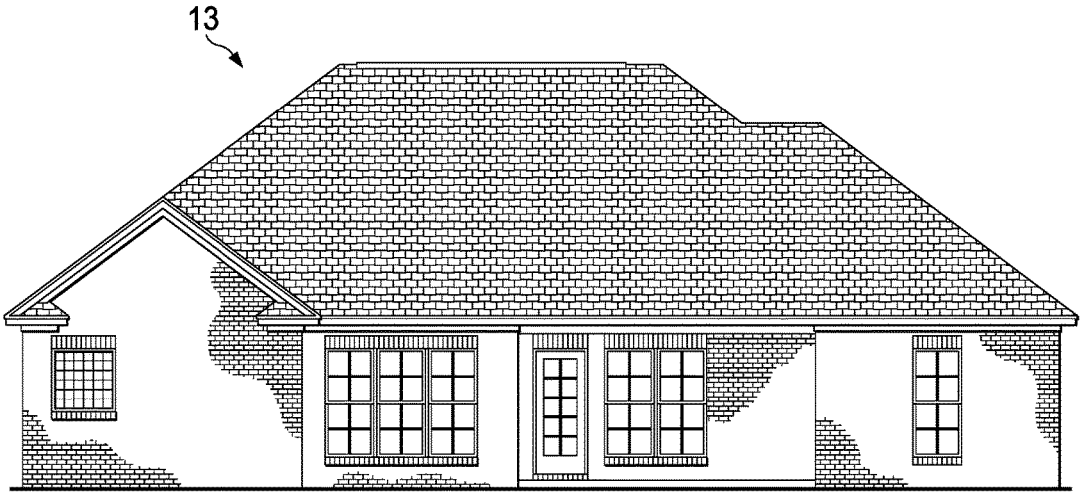
FIG. 2 is a rear view of the residential dwelling structure of FIG. 1.

FIGS. 1 and 2 are external front and rear views, respectively, of a tornado resistant/proof dwelling structure (designated generally as 11, 13) which was built according to the principles of the present invention. These views are mainly intended to be exemplary of the type of external facade that can be applied to the "internal reinforced concrete central core" of the structures of the invention (to be described in greater detail hereafter). In brief, the construction method of the invention involves the following steps:

first pouring a concrete slab;

thereafter, erecting a series of interconnected reinforced concrete boxes upon the concrete slab, each having sidewalls, an initially open top, and a bottom which is enclosed by the concrete slab;

installing a reinforced concrete ceiling which covers and encloses the top of the interconnected concrete boxes to form an internal reinforced concrete central core layout for the dwelling structure;

wherein the internal reinforced concrete central core layout has internal walls and external walls which are all constructed from insulated concrete forms which have been filled with concrete and reinforcing rebar; and erecting an external facade about the external walls of the internal reinforced concrete central core layout, thereby forming a dwelling structure exterior which mimics the exterior appearance of a typical subdivision home.

In more detail, the stages of construction for the tornado resistant/proof home of the invention include the following phases:

Phase I

Clear lot site, prepare ground for concrete slab, dig footers, install perimeter forms, install all foundation and slab re-bars per structural design drawings, all electrical and plumbing rough in work, pour 120 cubic yards of Readimix™ concrete with pump truck and finish.

Phase II

Layout all exterior walls for ICF Block installation, set first two courses with horizontal re-bars, level and square entire house, continue setting ICF Blocks up to 7th course to 10' 6" height, lay out and build all structural interior walls per design drawings, set all window and door bucks, all rough-in for plumbing and electrical inside walls installed, fill all walls with 81 cubic yards of concrete with pump truck.

Phase III

Set all shoring and bracing for pouring 6" concrete ceiling lid per design drawings (to close off top of the structural design engineered designed box), set all jacks, frames, I-beams and ¾" HDO plywood at height of 10' 6" throughout house, install perimeter edge, install all re-bar and set all exterior windows and doors.rs per design drawings, pour 54 cubic yards of concrete with pump truck and finish, rough in by all subs before pouring.

Phase IV

Construct 2×6 structural roof framing per design drawings, install roof vapor barrier and 30 year asphalt shingles per specs.

Phase V

Spray in all roof rafters R-38 foam insulation per specs.

Phase VI

Frame all other interior walls and drop ceilings, install dry all and finish, set all interior doors, all interior painting and staining per plans.

Phase VII

All exterior brick work and stone work per plans, pour concrete driveway and walks, finish landscaping and irrigation system, install garage door.

Phase VII

Install all finish floor coverings and millwork and finish plumbing, electrical, and HVAC.

Figure 4:
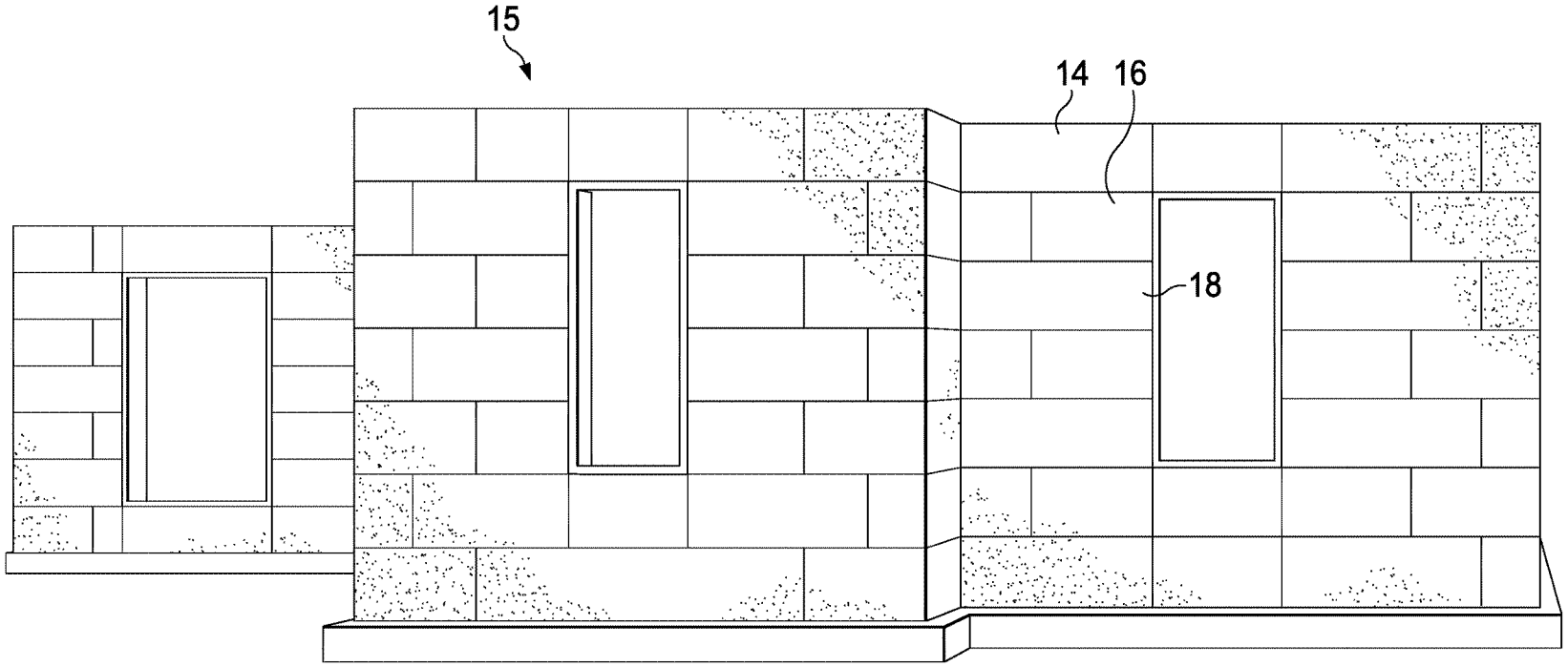
FIG. 4 is a view of the partially completed concrete reinforced central core of the dwelling structure of FIG. 1.

The Walls Making Up the Central Core Layout:

FIG. 4 shows the partially completed internally reinforced concrete central core layout of the dwelling structure of the invention (designated generally as 15). This central "core" is made entirely from what is known in the industry as "ICF" building materials. The building "blocks" used to construct the walls of the central core layout are illustrated, for example, as 14, 16, 18 in FIG. 4. The ICF construction technique is to be distinguished from conventional masonry construction. Masonry construction has been used to construct above and below walls, retaining walls, and foundations for centuries. Conventional masonry systems is the assembly of building blocks by laying blocks adjacent to each other with some type of mortar placed in-between two such adjacent blocks. However, a principal disadvantage of this type construction technique is the need for a skilled mason, as well as the time and material cost involved. The average person is unlikely to have the skill set to build such a wall because of the many issues involved, e.g., the needed consistency of the mortar, the aligning of adjacent blocks, the amount and level of mortar between the blocks, etc.

The construction projects of the invention instead use a self-interlocking block system that is mortarless, so that an unskilled laborer can easily and quickly build an above ground or below grade wall or foundation wall. The preferred mortarless system is known in the industry as the insulated concrete form or "ICF" system. One commercially available straight ICF block, known as the Fox™ ICF Straight Block, is described as follows:

The Straight Block typically makes up 85% of the ICF wall assembly on most residential & commercial jobs. This block has six (6) strong full length injection molded plastic ties made from Polypropylene (PP) regrind resin. These ties secure the two pieces of 1.5 pcf density modified Expanded Polystyrene (EPS) foam together that makes up each block type. The blocks are stacked tightly together and interlocked end to end to the desired wall length. Once a single layer or course of ICF blocks is installed, horizontal reinforcing steel bars are inter-locked securely together in the ties of the blocks, then another course of Straight Blocks are placed firmly on top as the wall is built. To improve construction wall strength during installation, each course of blocks should have their end joint connections staggered in a running bond method from the course adjacent to it. Typical dimensions are as follows:

| Core Width | Form Width | Length | Return | Surface Area | Concrete Vol |
|---|---|---|---|---|---|
| 4" | 9.25" | 48" | 0" | 5.33 sq. ft. | 0.066 cu. yd. |
| 6" | 11.25" | 48" | 0" | 5.33 sq. ft. | 0.099 cu. yd. |
| 8" | 13.25" | 48" | 0" | 5.33 sq. ft. | 0.132 cu. yd. |
| 10" | 15.25" | 48" | 0" | 5.33 sq. ft. | 0.165 cu. yd. |
| 12" | 17.25" | 48" | 0" | 5.33 sq. ft. | 0.198 cu. yd. |

ICF blocks are also commercially available in a variety of other forms including angle blocks, corner blocks, T-blocks, tapered blocks, ledge blocks, radius blocks and curb blocks.

Figure 5:
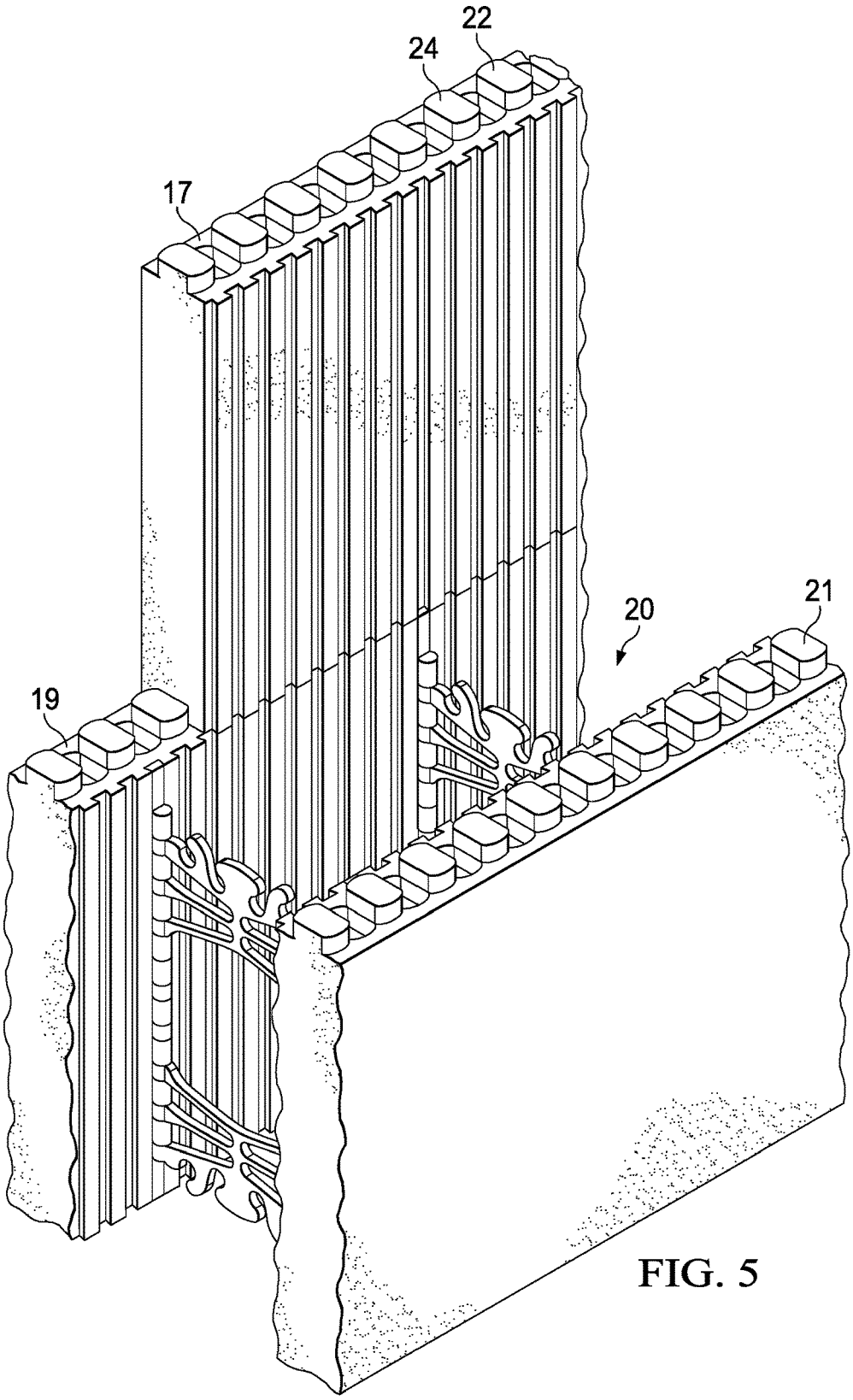
FIG. 5 is an isolated view of three of the insulated concrete form (ICF) blocks which are used in constructing the concrete reinforced central core of the dwelling structure of the invention.

FIG. 5 is exemplary of the use of such ICF blocks in constructing a building structure of the invention and shows a three ICF blocks (17, 19, 21) stacked upon one another to show the inner structure of the formwork used to construct the central core (15 in FIG. 4) of the building structure. After arranging a vertical column of the ICF forms, the cavity between the blocks (generally at 20 in FIG. 5) is filled with reinforced bar (rebar) and filled with concrete to create the permanent wall. The ICF blocks are left in place to provide added insulation to the completed structure. Commercially available ICF material, such as the previously described Fox™ ICF Blocks, is often described as comprising a formwork of special forms for reinforced concrete usually made with a rigid thermal insulation. The forms are interlocking modular units that are dry-stacked (without mortar) and filled with concrete. The units lock together somewhat like Lego™ bricks and create a form for the structural walls or floors of a building. The "pegs" 22, 24 shown in FIG. 5 are received in mating receptacle openings in the blocks of the next course of forms. ICF construction is presently used for both low rise commercial and high performance residential construction as more stringent energy efficiency and natural disaster resistant building codes are adopted. Buildings constructed with ICF forms of the type described are inherently more energy efficient, typically offering at least about a 50% savings on utility costs as compared to conventional masonry construction techniques.

Figure 8:
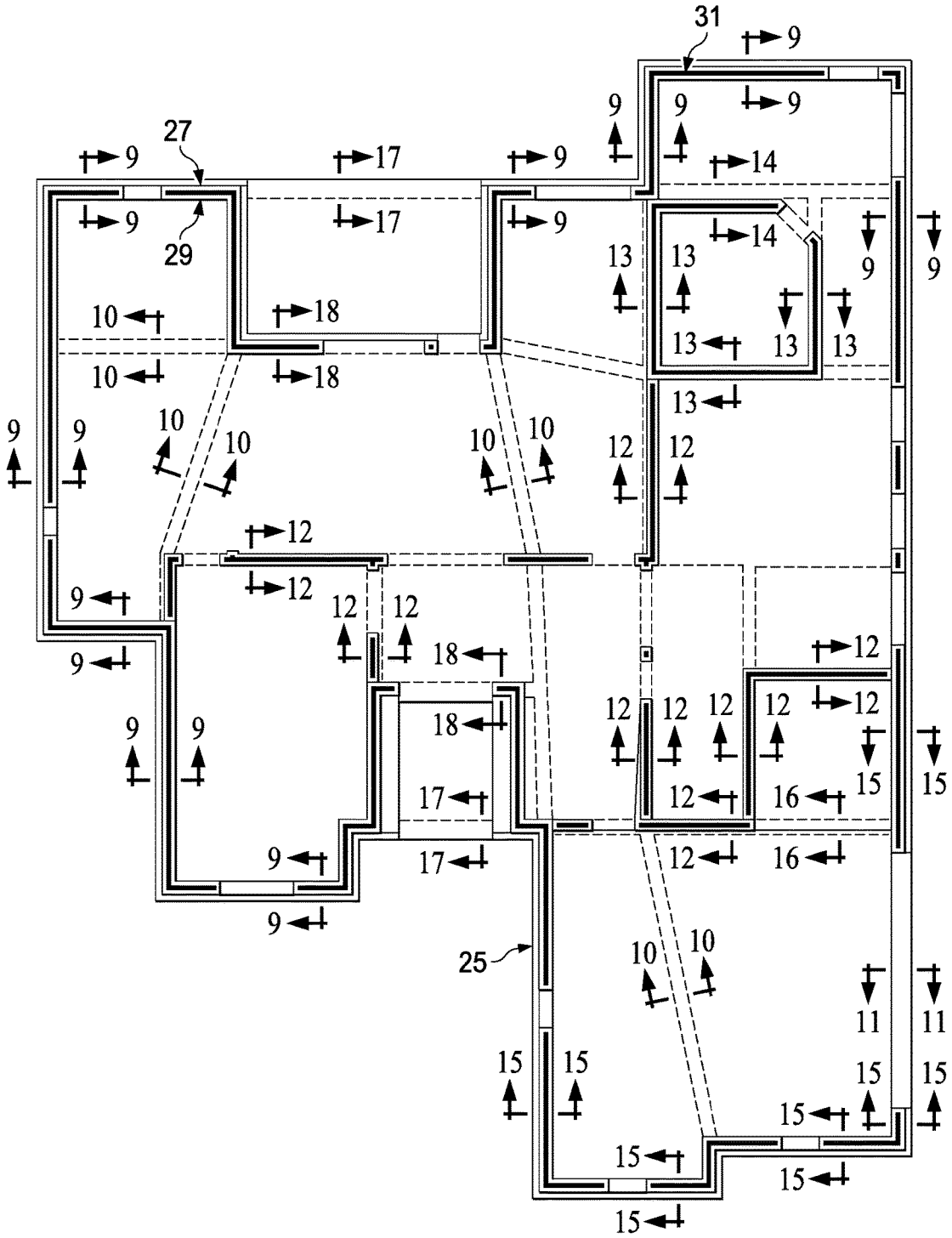
FIG. 8 is a foundation plan view of the residential dwelling structure of FIG. 1.

FIG. 8 shows the foundation plan for a dwelling constructed according to the principles of the present invention. A concrete slab 25 has a series of interconnected boxes built thereon. Each "box" has walls (such as exterior walls 27 and interior walls 29) built upon the concrete slab 25. As will be appreciated from FIG. 8, each box has an initially open top (generally at 31) and a bottom (opposite the open top 31) which is enclosed by the concrete slab.

Figure 9:
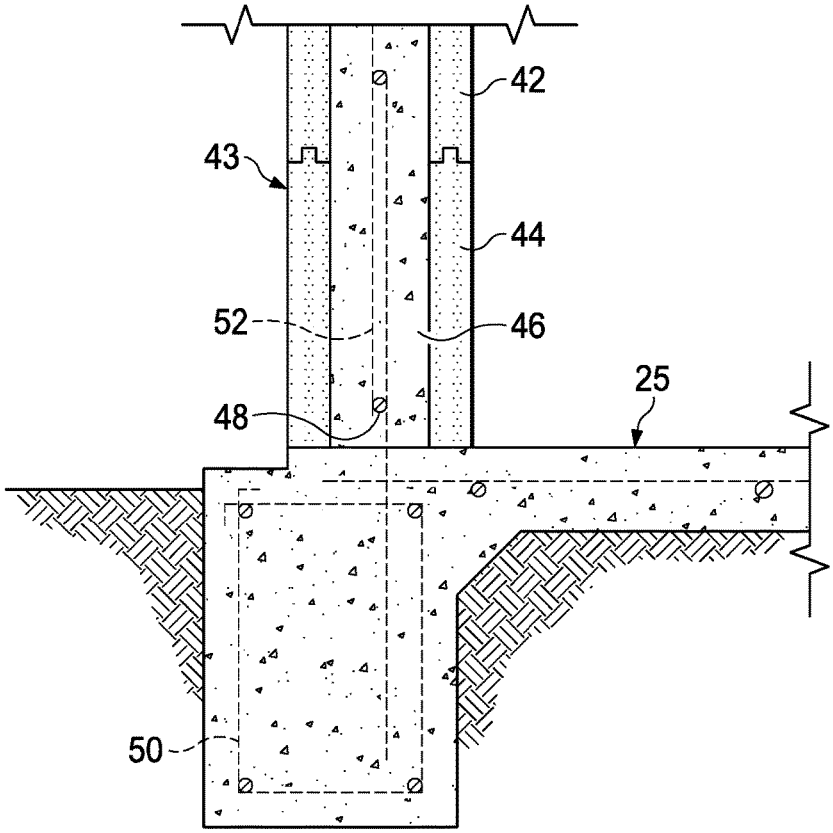
FIGS. 9-19 are partial, sectional views taken along the locations indicated in FIG. 8.
Figure 10:
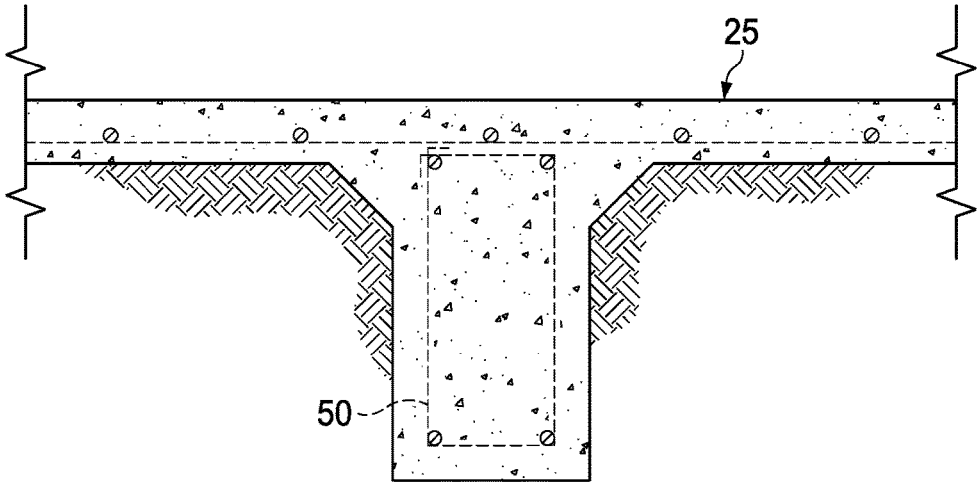
Figure 11:
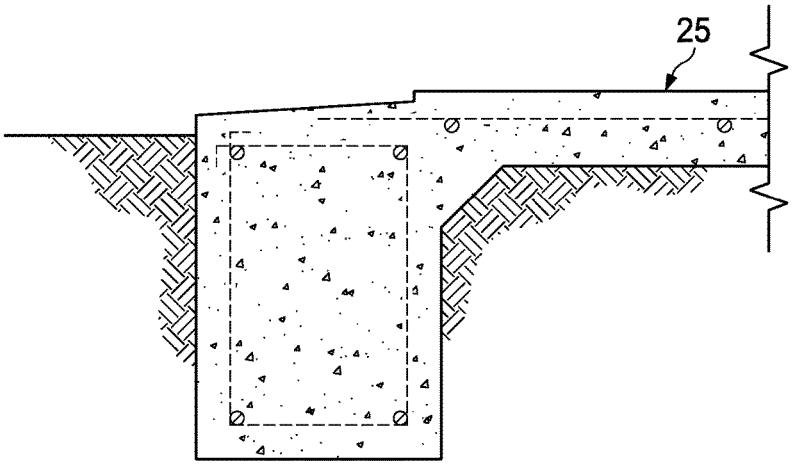
Figure 12:
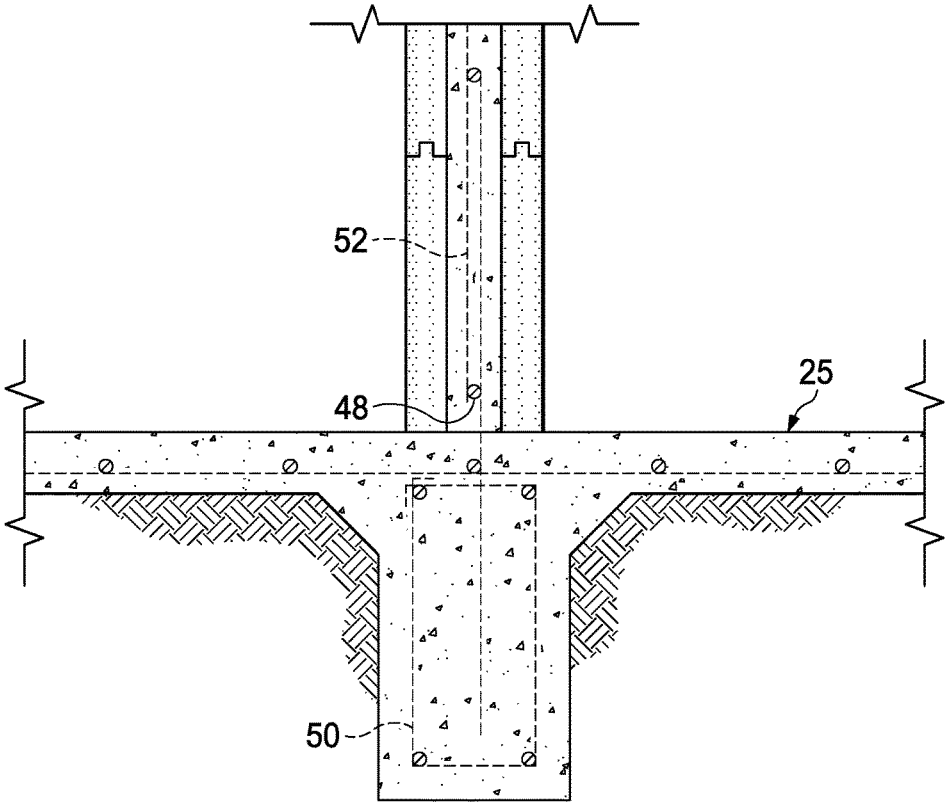
Figure 13:
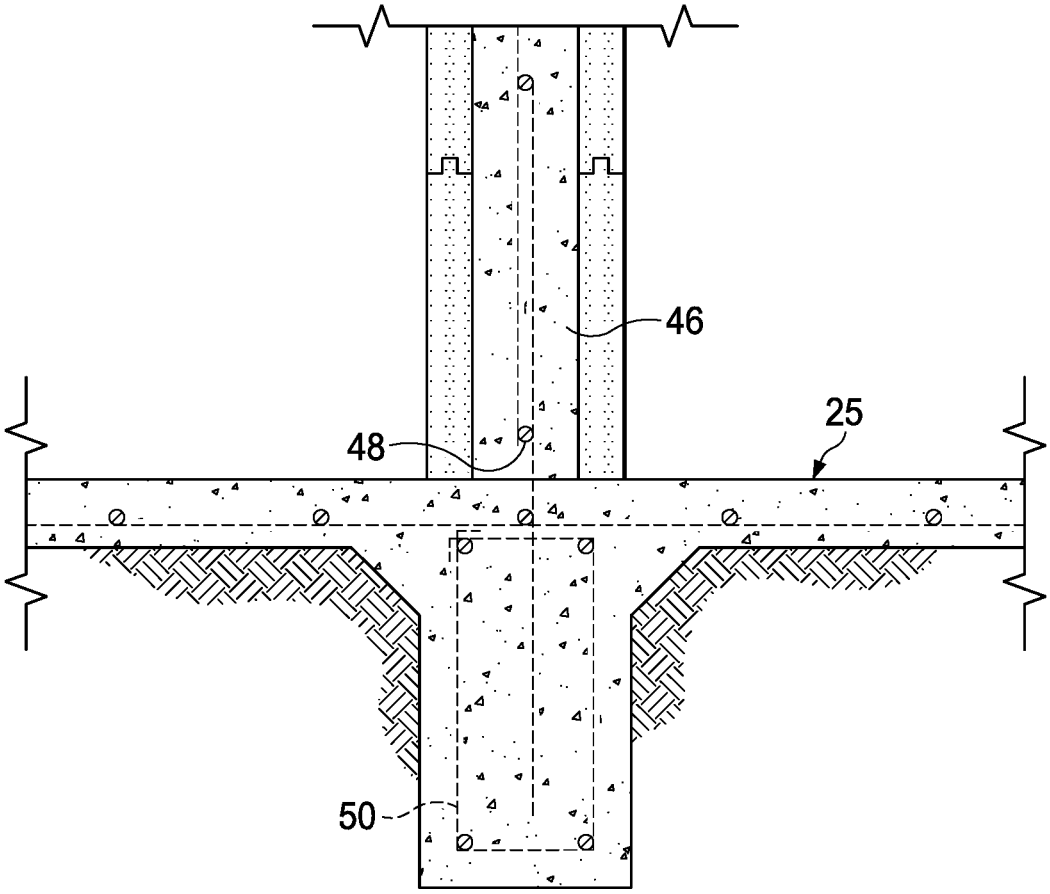
Figure 14:
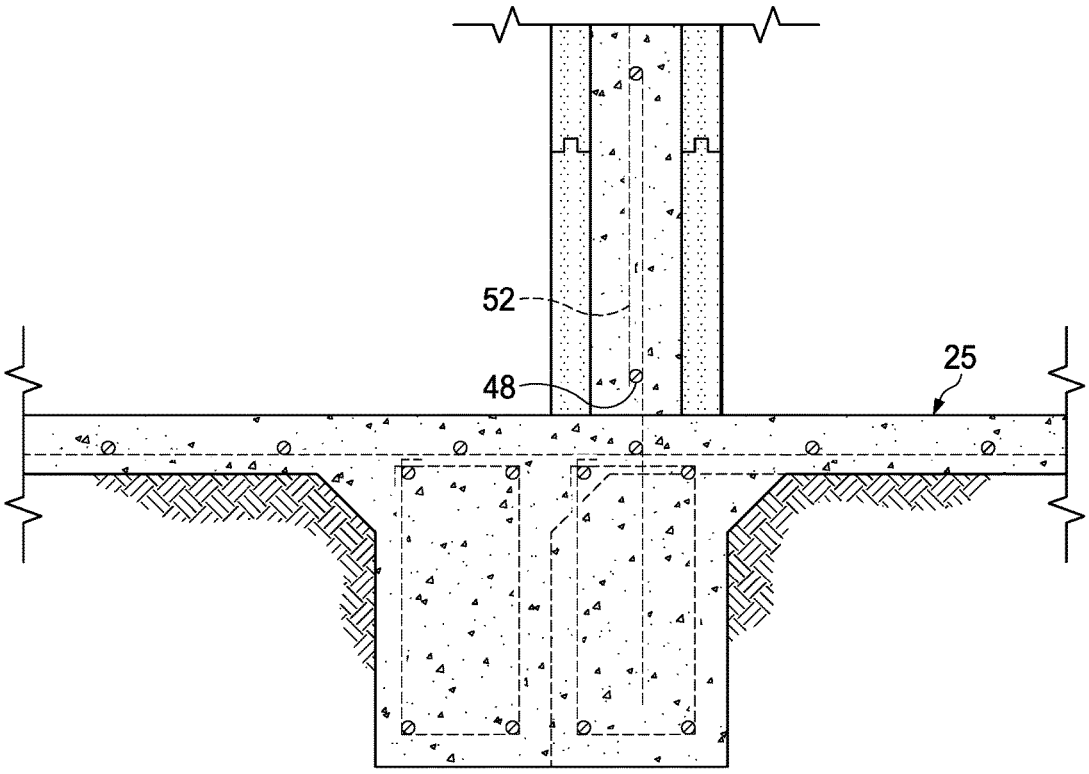
Figure 15:
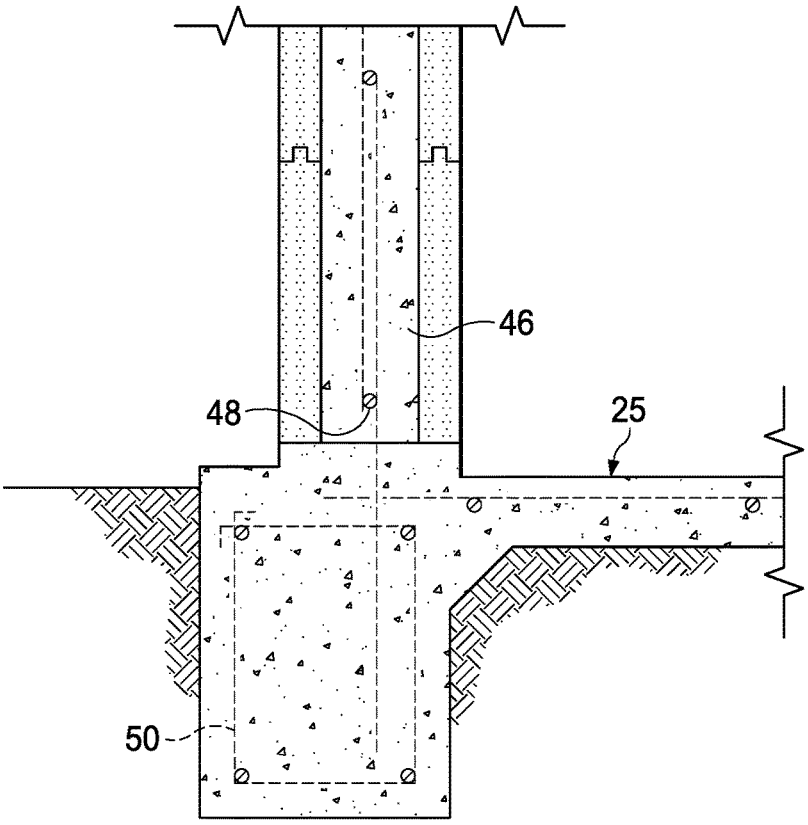
Figure 16:
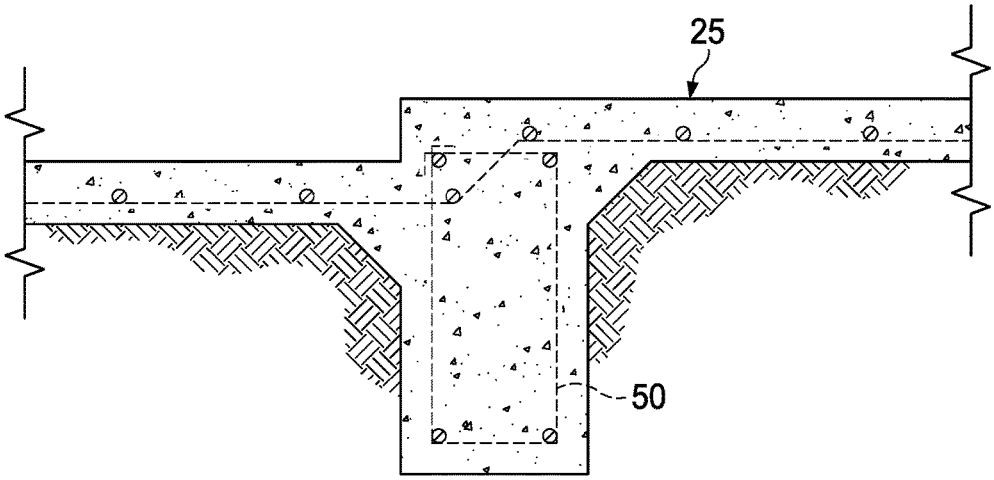
Figure 17:
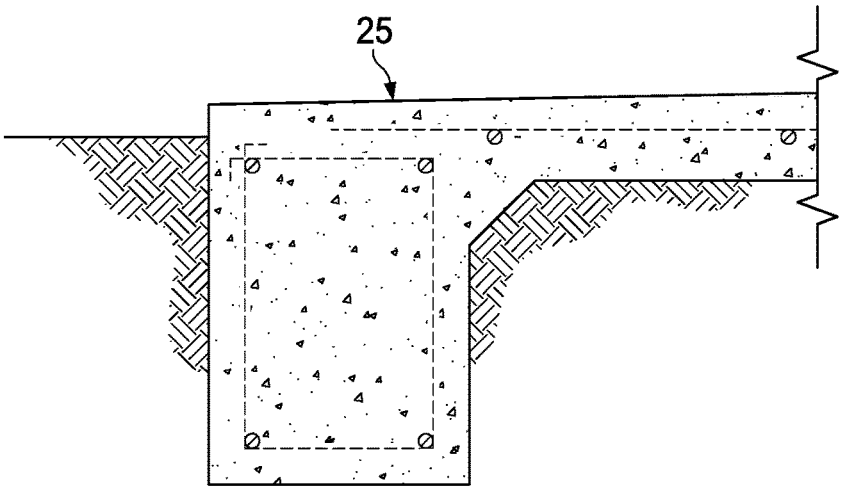
Figure 18:
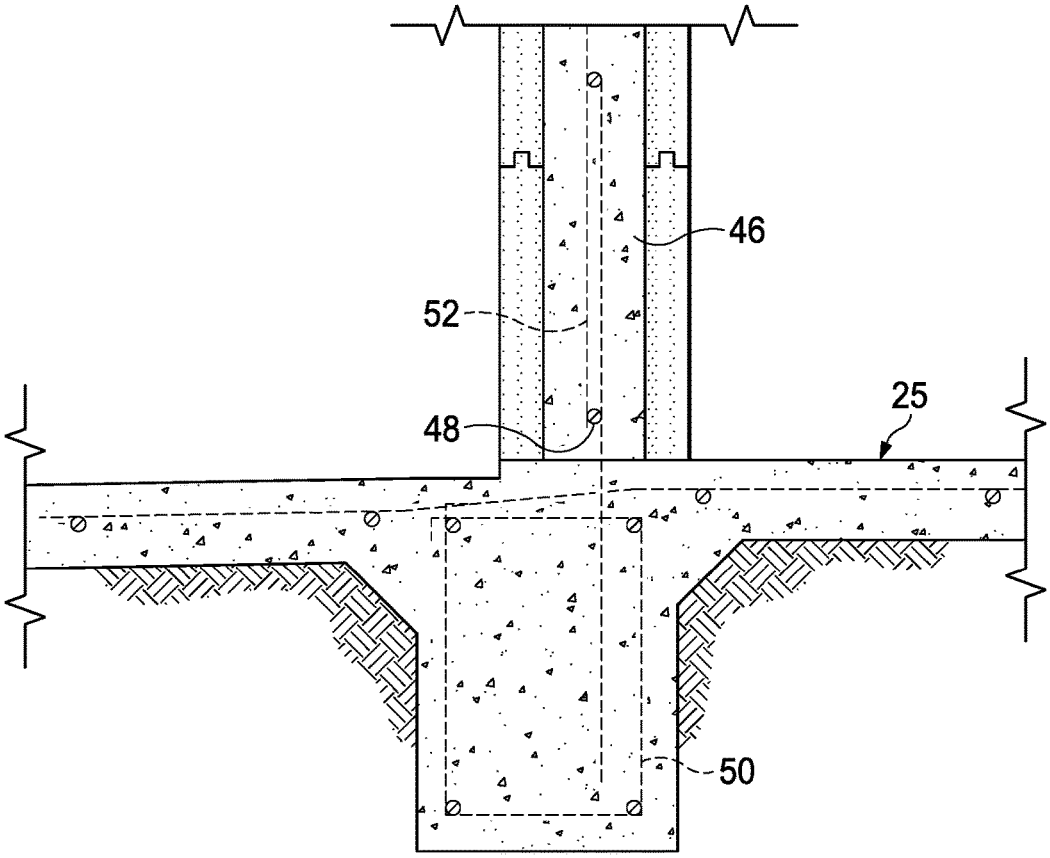
Figure 19:
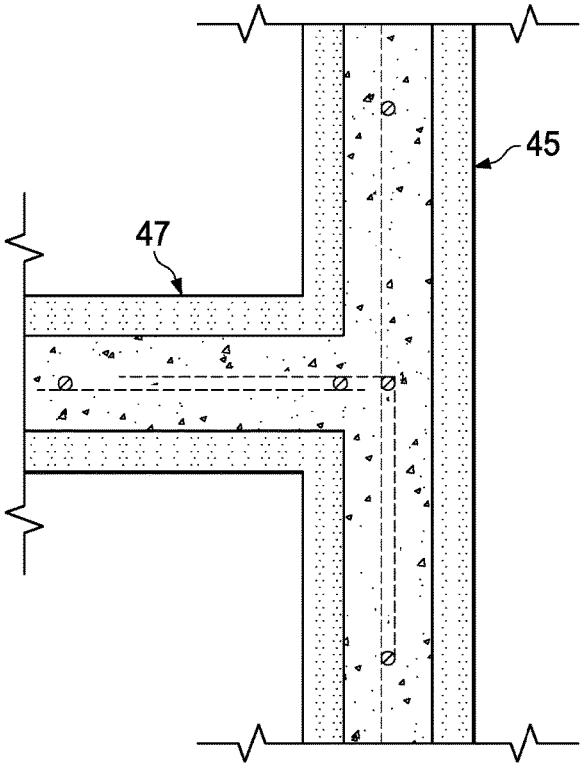

FIGS. 9-19 are isolated sectional views taken through the concrete slab 25 showing the placement of the vertical columns of ICF forms, such as the column 43 in FIG. 9. As will be appreciated from FIG. 9, the vertically arranged ICF forms 42, 44 have been filled with concrete 46 and reinforcing rebar 48. The forms 42, 44 and slab 25 also have vertically arranged rebar (such as rebar 50, 52) enclosed by the concrete 46. FIGS. 10-18 are additional sectional views of the slab 25 and vertical walls made up by the ICF forms. FIG. 19 shows the intersection of an external wall 45 and an internal wall 47, the walls again being formed of vertically stacked ICF forms.

Figure 6:
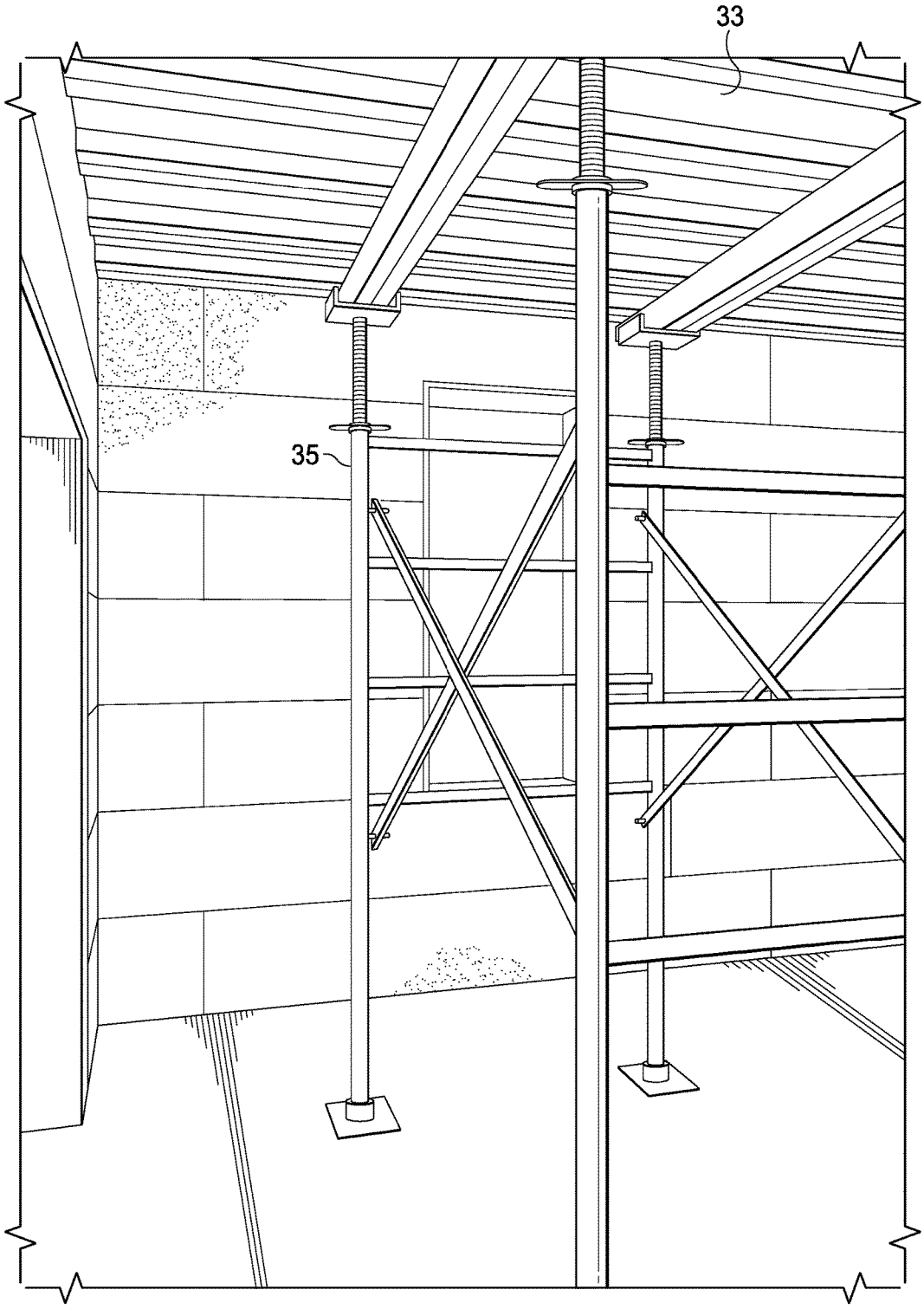
FIGS. 6 and 7 show the bracing used in constructing the solid concrete reinforced ceiling of the dwelling structure of the invention.
Figure 7:
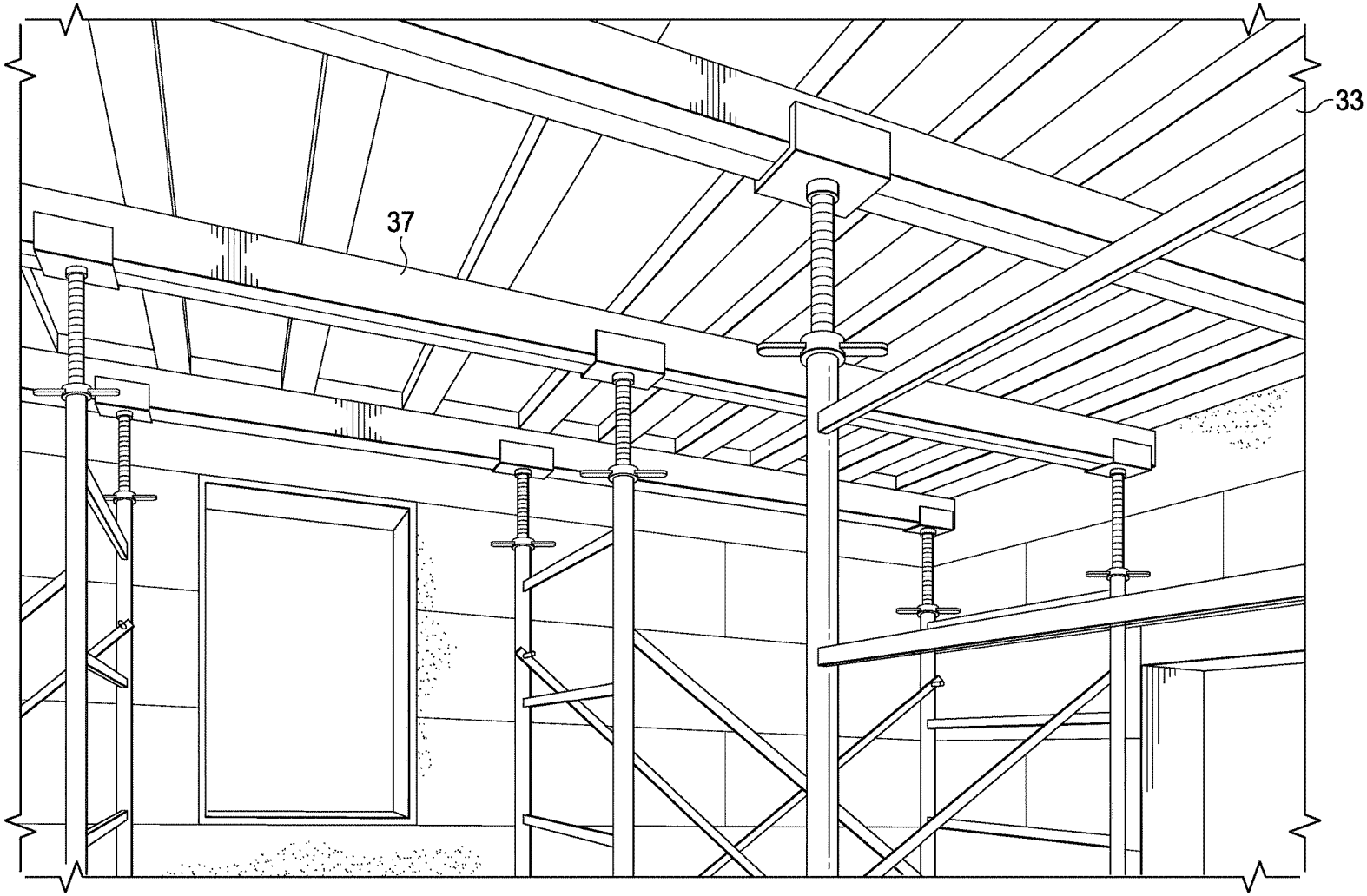
Figure 20:
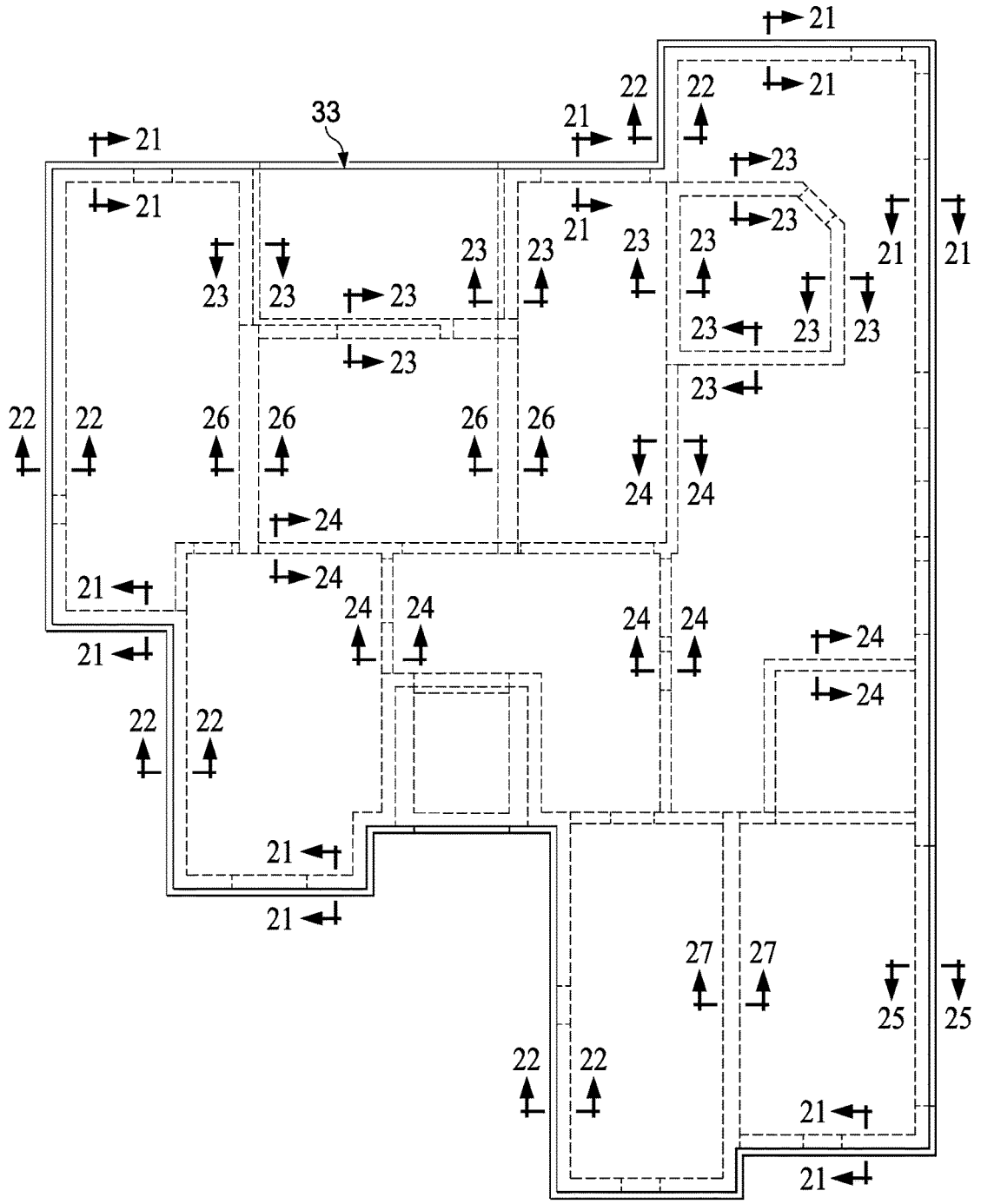
FIG. 20 is a concrete ceiling plan of the residential dwelling structure of FIG. 1 constructed according to the method of the invention.

The Reinforced Concrete Ceiling of the Structure:

A reinforced concrete ceiling (generally at 33 in FIG. 20) covers and encloses the initially open top of the series of boxes to form what might be thought of as an internal reinforced concrete central core layout for the dwelling structure. FIGS. 6 and 7 show the support structures (generally at 35, 37) which are used to support the concrete ceiling as the concrete is being poured and allowed to harden. The ceiling 33, which encloses the concrete "boxes," is constructed in the same general manner as concrete commercial structures are constructed for parking garages, high rise office buildings, and the like. The temporary bracing 35, 37 is removed once the concrete ceiling has hardened.

Figure 21:
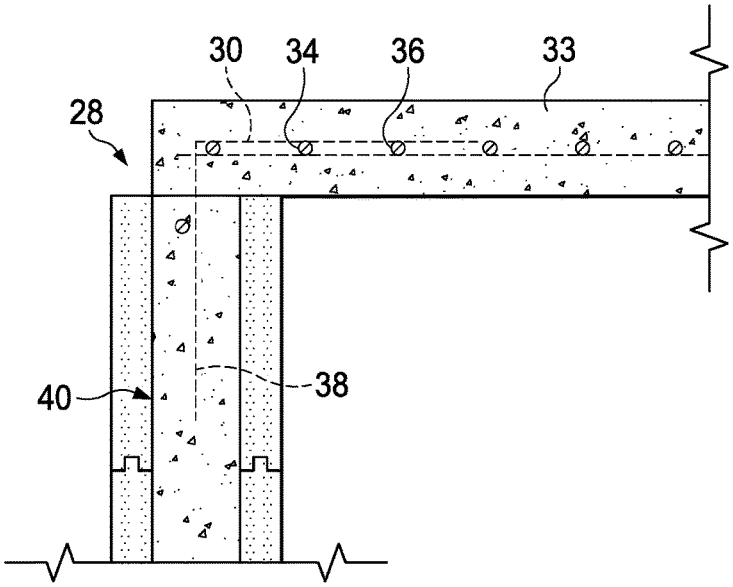
FIGS. 21-27 are partial, sectional views taken along the locations indicated in FIG. 20.
Figure 22:
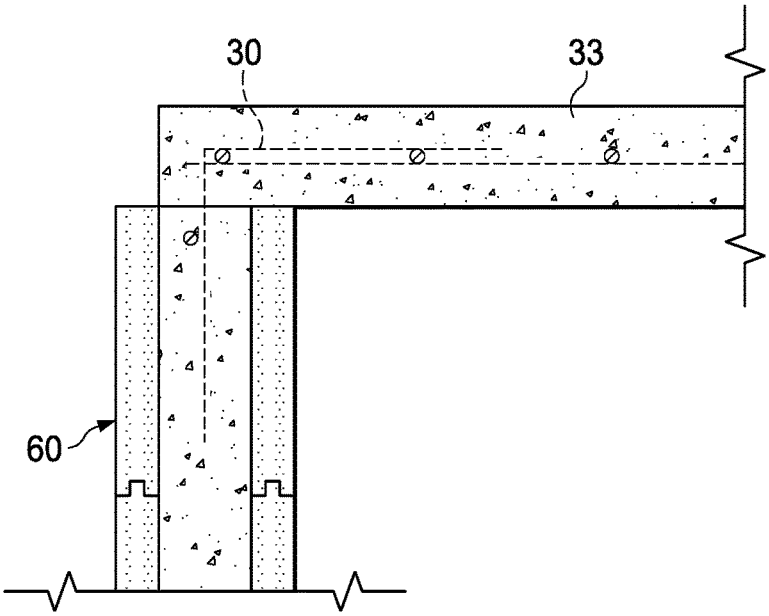
Figure 23:
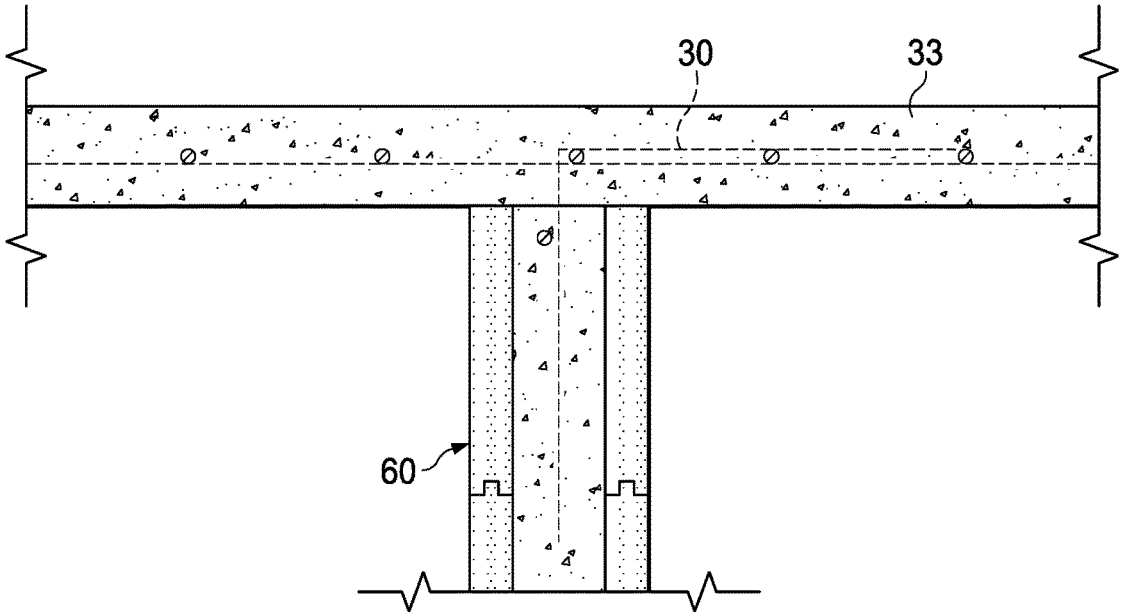
Figure 24:
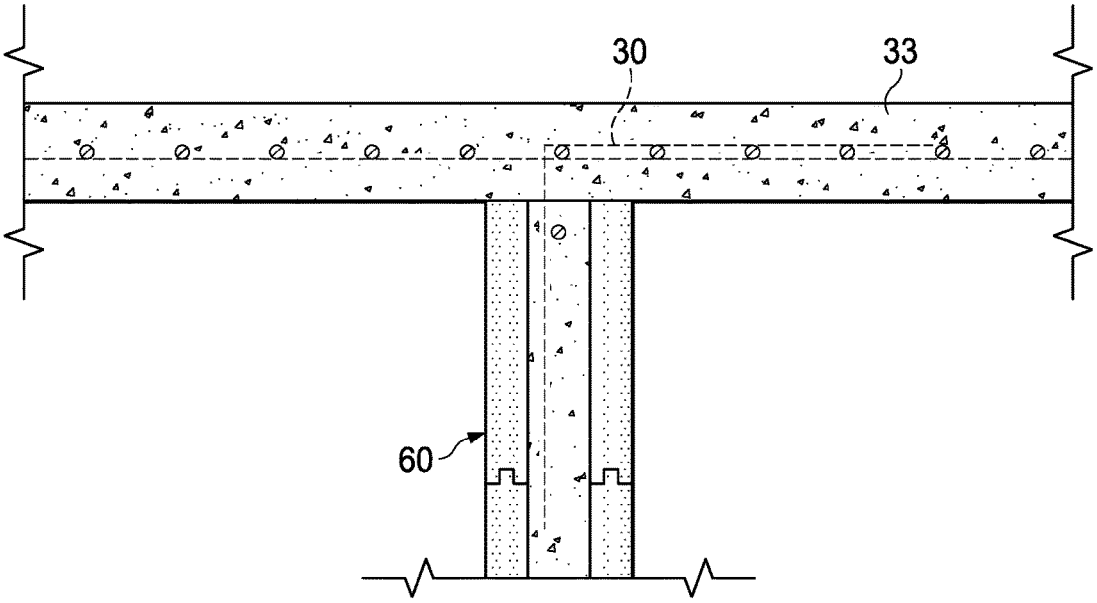
Figure 25:
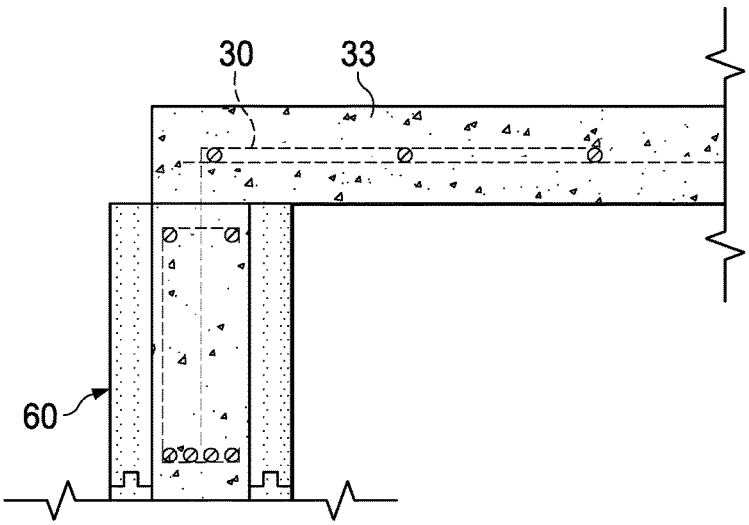

As will be appreciated from FIG. 21, the concrete ceiling 33 is reinforced by horizontally arranged rebar rods (as at 34, 36). Vertical rebar rods 38 are bent over from the vertical position in the upright column 40 to the horizontal position shown as 30 in FIGS. 21 and 22, further reinforcing and strengthening the concrete ceiling 33.

Figure 26:
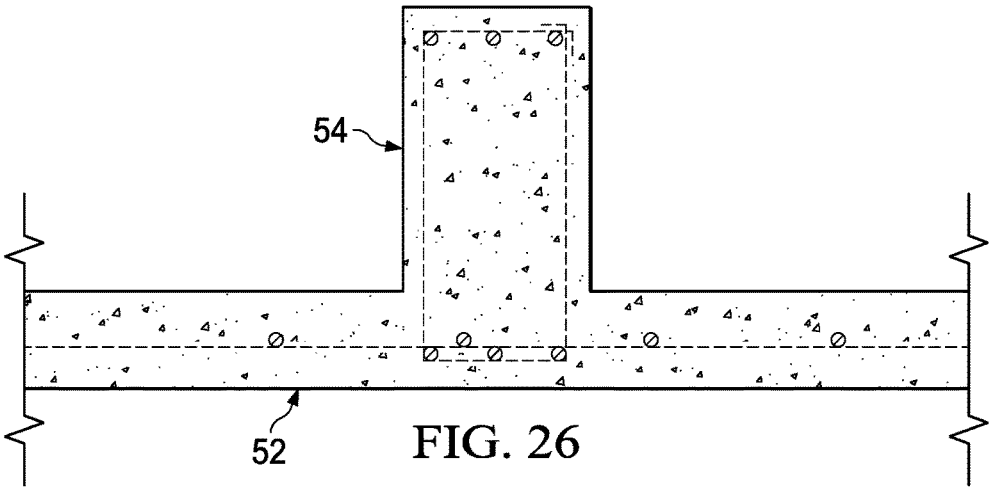
Figure 27:
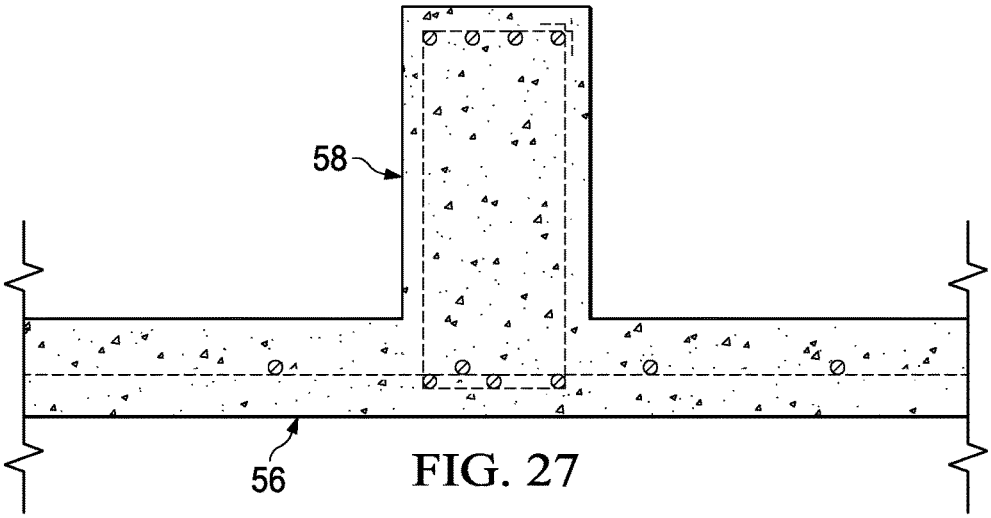

FIGS. 22-27 are additional sectional views of the concrete ceiling 33 showing the intersection of the vertical walls (60 in FIGS. 22-25). FIGS. 26 and 27 are sectional views of the intersection of two external and internal walls 52, 54 and 56, 58, respectfully.

The Completed Structure:

The completed internal reinforced concrete central core layout thus has internal and external walls which are constructed using the ICF building blocks previously described which are filled with concrete and reinforcing rebar, with the rebar running vertically between the concrete slab and the concrete ceiling. The walls of the central core layout will typically be a minimum of 6 inch thick concrete.

Figure 3:
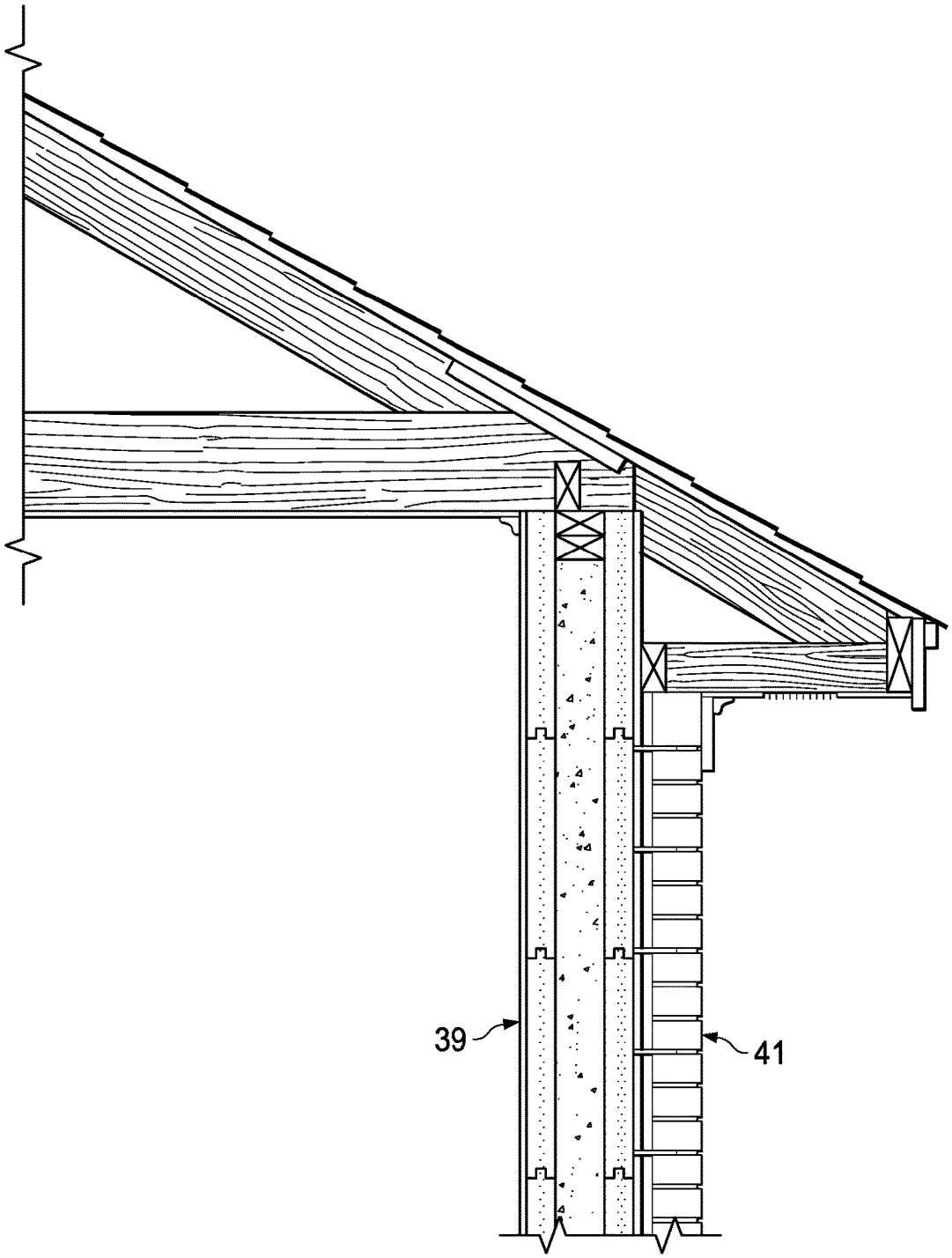
FIG. 3 is a partial, isolated view of the cornice detail of the dwelling structure of the invention.

An external facade is then erected so as to cover the central core layout so that the external facade mimics the exterior appearance of a typical subdivision home, for example, such as the nearby homes in the subdivision being constructed by traditional brick and mortar principles. As previously mentioned, FIGS. 1 and 2 are views of the exterior of a model home constructed according to the principles of the invention. FIG. 3 is a cornice detail which shows an external wall 39 made up of a vertical column of the ICF forms which is covered by a brick exterior facade 41. The interior walls of the structure can also be finished out in conventional fashion.

An invention has been provided with several advantages. The construction techniques of the invention provide a tornado resistant/proof building, which can be a residential dwelling, which is capable of withstanding high winds on the order of 250 mph. The reinforced central core provides "whole house protection" for the inhabitants. It is not necessary that the inhabitants locate and run to a storm shelter or "safe room" within or adjacent to the structure. While the techniques of the invention provide unique safety considerations, the external appearance of the dwelling structure is indistinguishable from adjacent houses in the same neighborhood. The reinforced structures of the invention do not exhibit the "concrete cast block" external appearance of prior art "storm proof" housing designs, such as the hurricane resistant structures build along the coastal regions of the country. Because of the very nature of the ICF block construction, the homes of the invention are necessarily very energy efficient, providing long term cost savings for the inhabitants.

While the invention has been shown in only one of its forms, it is not thus limited but is susceptible to various changes and modifications without departing from the spirit thereof.

What is claimed is:

1. A method of constructing a tornado resistant/proof dwelling structure, the method comprising the steps of:

pouring a concrete slab;

erecting a series of interconnected reinforced concrete boxes upon the concrete slab, each having sidewalls, an initially open top, and a bottom which is enclosed by the concrete slab;

installing a reinforced concrete ceiling which covers and encloses the top of the interconnected concrete boxes to form an internal reinforced concrete central core layout for the dwelling structure;

wherein said installing reinforced concrete ceiling produces a structural concrete slab roof over the interconnected boxes, whereby the interconnected concrete boxes no longer consist of walls alone but become an interconnected structural shape of greater strength than concrete walls alone would provide;

wherein the internal reinforced concrete central core layout has internal walls and external walls both of which are all constructed from insulated concrete forms which have been filled with concrete and reinforcing rebar, the insulated concrete forms comprising a self-interlocking block system that is mortarless with each block in the system being connected to a similar spaced apart block by a plurality of plastic ties, thereby creating a void space which will ultimately be filled with concrete, a series of the blocks being interlocked end to end to form a first course of blocks of a desired wall length, wherein once a single layer of blocks is installed, horizontal reinforcing steel bars are secured together in the ties of the blocks, after which a second course of blocks are placed on top of the first course of blocks as the wall is built;

wherein the insulated concrete form blocks are left in place after the concrete is poured to provide added insulation to the dwelling structure; and erecting an external facade about the external walls of the internal reinforced concrete central core layout, thereby forming a dwelling structure exterior which mimics an exterior appearance of a typical subdivision home.

2. The method of claim 1, wherein the external walls of the internal reinforced concrete central core of the dwelling structure are designed to withstand 250 mph winds.

3. The method of claim 2, wherein the external walls of the internal reinforced concrete central core of the dwelling structure are a minimum of 6 inch thick concrete.

4. The method of claim 3, wherein the reinforced concrete ceiling of the internal reinforced concrete central core of the dwelling structure is a minimum of 6 inch thick concrete.

5. A method of constructing a tornado resistant/proof dwelling structure, the method comprising the steps of:

pouring a concrete slab;

erecting a series of interconnected reinforced concrete boxes upon the concrete slab, each having sidewalls, an initially open top, and a bottom which is enclosed by the concrete slab;

installing a reinforced concrete ceiling which covers and encloses the top of the interconnected concrete boxes to form an internal reinforced concrete central core layout for the dwelling structure;

wherein the installation of the reinforced concrete ceiling produces a structural concrete slab roof over the interconnected boxes, whereby the interconnected concrete boxes no longer consist of walls alone but become an interconnected structural shape of greater strength than concrete walls alone would provide;

wherein the reinforced concrete ceiling is reinforced with horizontally arranged rebar rods, the reinforced concrete ceiling being supported above vertical upright concrete columns which contain vertical rebar rods which are bent at an outer extent thereof to a horizontal position, the bent outer extents within the concrete of the ceiling, further reinforcing and strengthening the concrete ceiling;

wherein the internal reinforced concrete central core layout has internal walls and external walls both of which are all constructed from insulated concrete forms made of expanded polystyrene foam which have been filled with concrete and reinforcing rebar, the insulated concrete forms comprising a self-interlocking block system that is mortarless with each block in the system being connected to a similar spaced apart block by a plurality of injection molded plastic ties made from polypropylene regrind resin, thereby creating a void space which will ultimately be filled with concrete, a series of the blocks being interlocked end to end with pegs on one block being received into mating receptacles on a next adjacent block to form a first course of blocks of a desired wall length, wherein once a single layer of blocks is installed, horizontal reinforcing steel bars are secured together in the ties of the blocks, after which a second course of blocks are placed on top of the first course of blocks as the wall is built;

wherein the external walls of the internal reinforced concrete central core of the dwelling structure are a minimum of 6 inch thick concrete;

wherein the reinforced concrete ceiling of the internal reinforced concrete central core of the dwelling structure is a minimum of 6 inch thick concrete;

wherein the external walls of the internal reinforced concrete central core of the dwelling structure are designed to withstand 250 mph winds;

wherein the insulated concrete form blocks are left in place after the concrete is poured to provide added insulation to the dwelling structure; and wherein an external facade is erected about the external walls of the internal reinforced concrete central core layout, thereby forming a dwelling structure exterior which mimics an exterior appearance of a typical subdivision home.

* * * * *